US005782009A

United States Patent [19]

Kotitschke

[11] Patent Number: 5,782,009

[45] Date of Patent: Jul. 21, 1998

[54] DEVICE FOR GUIDING A SHEET OF FIBROUS MATERIAL IN A SINGLE-ROW DRYER PART

[75] Inventor: Gerhard Kotitschke, Steinheim, Germany

[73] Assignee: Voith Sulzer Papiermaschinen GmbH, Heidenheim, Germany

[21] Appl. No.: 791,780

[22] Filed: Jan. 29, 1997

[30] Foreign Application Priority Data

Jan. 30, 1996 [DE] Germany ..... 296 01 543 U

[51] Int. Cl.[6] ..... D21G 5/00

[52] U.S. Cl. ..... 34/117; 34/114

[58] Field of Search ..... 34/111, 114, 115, 34/116, 117, 119, 120, 121, 122, 123, 124

[56] References Cited

U.S. PATENT DOCUMENTS

| | | | |
|---|---|---|---|
| 3,320,677 | 5/1967 | Reitzel | 34/111 |
| 4,359,828 | 11/1982 | Thomas | 34/114 |
| 4,441,263 | 4/1984 | Vedenpaa | 34/115 |
| 4,905,380 | 3/1990 | Eskelinen et al. | 34/116 |
| 5,068,980 | 12/1991 | Muller | 34/117 |
| 5,086,571 | 2/1992 | Hietanen | 34/117 |
| 5,115,581 | 5/1992 | Viitanen | 34/115 |
| 5,341,579 | 8/1994 | Schiel et al. | 34/115 |
| 5,477,624 | 12/1995 | Haessner et al. | 34/117 |
| 5,515,619 | 5/1996 | Kahl et al. | 34/114 |

FOREIGN PATENT DOCUMENTS

| | | |
|---|---|---|
| 4141296 | 6/1993 | Germany . |
| 4314475 | 12/1993 | Germany . |
| 29601543.1 | 5/1996 | Germany . |
| 9403675 | 2/1994 | WIPO . |

OTHER PUBLICATIONS

European Search Report and Annex, dated Jun. 17, 1997.

*Primary Examiner*—Henry A. Bennett
*Assistant Examiner*—Pamela A. Wilson
*Attorney, Agent, or Firm*—Greenblum & Bernstein, P.L.C.

[57] ABSTRACT

A device for guiding a sheet of fibrous material to be dried and a support belt through a drying device. The device including an external suction box having first and second openings located adjacent a deflection roll and adjacent to a lift-off point associated with a first dryer cylinder, respectively. The external suction box also including a first and second aspiration conduit respectively associated with the first and second openings. The deflection roll may be aspirated by an external vacuum souce coupled to the external suction box. The fibrous sheet, through the support belt, may be assisted at the lift-off point by aspiration by a separate external vacuum source coupled to the second aspiration conduit.

20 Claims, 1 Drawing Sheet

DEVICE FOR GUIDING A SHEET OF FIBROUS MATERIAL IN A SINGLE-ROW DRYER PART

CROSS-REFERENCE OF RELATED APPLICATION

The present invention claims the priority under 35 U.S.C. § 119 of German Patent Application No. 296 01 543.1 filed on Jan. 30, 1996, the disclosure of which is expressly incorporated by reference herein in its entirety.

BACKGROUND OF THE INVENTION

1. Field of the Invention

The present invention may be directed to a device for guiding a sheet of fibrous material to be dried and a porous support belt through a web drying device. In particular, the present invention may be directed to device in which the sheet and support belt may be guided around a first circumferential portion of a deflection roll and an external suction box may be located adjacent substantially the remaining circumferential portion of the deflection roll. The external suction box may be utilized to guide the sheet and support belt and to deflect air currents entrained by the moving support belt and sheet. Further, the external suction box may include at least two vacuum sources to provide different vacuum pressures within a single suction box.

2. Discussion of Background Information

Devices for guiding fibrous sheets of material have generally been described in, e.g., DE 43 14 475 A1. The prior art shows a device in which a part of the circumference of a deflection roll, i.e., free of a support belt and sheet, is covered to a large extent by an external suction box.

The external suction box is used in the prior art within a single-row drier group. The external suction box aspirates a porous support belt rolling off a dryer cylinder so the sheet of fibrous material rests smoothly on the support belt, thus, reliably guiding the sheet to the deflection roller. Simultaneously, the external suction box aspirates a deflection roller including, e.g., recesses or perforations. As a result, the sheet of fibrous material is sucked (adhered) against the porous support belt and deflected around the deflection roll in a reliable manner. After deflection, the support belt and sheet are guided to a next drying cylinder. In guidance devices of this type, a zone where the support belt and sheet roll off, i.e., separate from, the dryer cylinder is a critical region. In this critical region, particularly intense suction forces are required to securely lay the sheet of fibrous material down on the support belt.

An increased vacuum in the external suction box is necessary in the above-noted zone, and, thus, the external suction box must be more intensely aspirated. However, this greater vacuum is simultaneously applied to the other regions effected by the external suction box. However, these other regions generally do not require this high vacuum at all. Thus, a sweeping increase of the vacuum leads to a sharply increasing vacuum loss due to leakage.

SUMMARY OF THE INVENTION

An object of the present invention may be to improve the noted drawbacks and disadvantages of the prior art.

Therefore, the present invention may include an external suction box having at least one suction opening facing a pickup zone and at least one suction opening facing a porous or perforated deflection roll. The external suction box may be coupled to a first and second vacuum source which may produce a first and second vacuum pressure, which may be different in amount. Because of the separate suction in the pick-up zone, the suction amount may be varied in accordance with the given requirements without the suction amounts in the other regions being changed. Since in the invention, only a relatively small region is acted upon by a higher vacuum, the leakage losses are much lower than in similar devices in the prior art.

Accordingly, the present invention may be directed to a device for drying a sheet of fibrous material. The sheet may be guided, with a porous support belt, through a dryer section, including at least a first and second at least partially heatable dryer cylinder and at least one deflection roll having one of a perforated and porous roll jacket. The porous support belt may guide the fibrous sheet from the first dryer cylinder to the deflection roll and from the deflection roll to the second dryer cylinder. The device may include an external suction box, including at least a first and second opening associated with respective at least first and second aspiration conduits, coupled to a plurality of external vacuum sources. The first opening may be positioned adjacent a circumferential portion the deflection roll and may include a first and second seal rail extending along opposite sides of the first opening and adjacent the deflection roll. The second opening may be positioned adjacent a portion of the porous belt that includes a lift-off point where the fibrous sheet separates from the first dryer cylinder. The second opening may include at least two sealing rails extending perpendicular to a direction of travel of the fibrous sheet and disposed on opposite sides of the lift-off point. One of the at least two sealing rails may include a deflection sealing rail that deflects air currents entrained by the porous support belt. The plurality of external vacuum sources may include a first external vacuum source coupled with an internal portion of the deflection roll and a second external vacuum source coupled with the lift-off point.

In accordance with another feature of the present invention, the second aspiration conduit may include a plurality of separate vacuum sources.

In accordance with another feature of the present invention, the device may also include a device that regulates an air flow of the second aspiration conduit.

In accordance with still another feature of the present invention, the second aspiration conduit may include a plurality of adjacent chambers linearly arranged parallel to the at least two sealing rails. Each chamber may have a suction zone with varying suction.

In accordance with a further feature of the present invention, the second aspiration conduit may include a separate suction zone located adjacent an edge of the fibrous sheet for threading the fibrous sheet.

The present invention may also be directed to an external suction box for use in a dryer in a fibrous sheet production machine. The dryer may include a porous support belt guiding the fibrous sheet, at least a partially heatable first and second dryer cylinder, and at least one deflection roll having a perforated roll jacket. The porous support belt may guide the fibrous sheet around at least a portion of the first dryer cylinder, around a portion of the deflection roll, and around a portion of the second dryer cylinder. The external suction box may include a first and second aspirating conduit. The first aspirating conduit may be connectable to a first external vacuum source and the second aspirating conduit may be connectable to a second external vacuum source. The external suction box may also include a separating wall that separates a vacuum pressure within the first aspirating conduit and a vacuum pressure with the second aspirating conduit.

In accordance with another feature of the present invention, the external suction box may also include a first opening and a first and second sealing rail. The first and second sealing rail may be located substantially parallel to each other and may extend along an entire length of the external suction box and may be positioned on opposite sides of the first opening, which may be positionable adjacent to the deflection roll. The external suction box may also include a second opening and a third and fourth sealing rail. The third and fourth sealing rail may be located substantially parallel to each other and may extend along an entire length of the external suction box and may be positioned on opposite sides of the second opening. The second opening may be positionable adjacent to a lift-off point at which the fibrous sheet separates from the first dryer cylinder.

In accordance with further feature of the present invention, the external suction box may be combined with the dryer of the production machine. The combination may include a first external vacuum source coupled to the first aspirating conduit and a second external vacuum source coupled to the second aspirating conduit. The first and second sealing rails may be abuttingly positioned against the deflection roll, the first external vacuum source may communicate with an interior portion of the deflection roll. The third and fourth sealing rails may be positioned adjacent a pick-up zone, the pick-up zone include the lift-off point, and the second external vacuum source may facilitate separation of the fibrous sheet from the first dryer cylinder.

In accordance with yet another feature of the combination of present invention, the third sealing rail may be located upstream the fourth sealing rail with respect to a direction of fibrous sheet travel and the third sealing rail may also deflect air currents entrained by movement of the porous support belt.

In accordance with a still further feature of the combination of the present invention, the first aspiration conduit may aspirate a region located between the porous support belt and an exterior of the external suction box. Further, the region located between the porous support belt and the exterior of the external suction box may include at least one of between the first dryer cylinder and the deflection roll and between the deflection roll and the second dryer cylinder.

In accordance with another feature of the combination of the present invention, the first external vacuum source and the second external vacuum source may exert different vacuum pressures.

In accordance with still another feature of the combination of the present invention, the second aspirating conduit may include a plurality of chambers, each chamber adjacently arranged along the entire length of the external suction box.

In accordance with a further feature of the combination of present invention, each chamber may be coupled to a separate vacuum source to vary the vacuum pressure along the length of the external suction box.

In accordance with a still further feature of the combination of the present invention, vacuum pressure sources associated with chambers located adjacent an edge of the fibrous sheet may exert a higher pressure than vacuum pressure sources associated with chambers located adjacent internal portions of the fibrous sheet.

In accordance with another feature of the combination of the present invention, the first and second rails may be located substantially close to a run-on point and lift-off point of the deflection roll and the external suction box may be coupled to substantially an entire circumference of the deflection roll not abutting the porous support belt.

In accordance with another feature of the present invention, the first aspiration conduit may include a plurality of chambers.

In accordance with still another feature of the present invention, the plurality of chambers may be located adjacent one another and may extend along an entire length of the external suction box.

In accordance with still another feature of the present invention, the external suction box may include a housing, positionable between the porous support belt and the deflection roll, that may include a first and second opening coupled to the first aspirating conduit and the second aspirating conduit, respectively.

In accordance with yet another feature of the present invention, the housing may be substantially triangular in shape.

Further embodiments and advantages can be seen from the detailed description of the present invention and the accompanying FIGURE.

BRIEF DESCRIPTION OF THE DRAWINGS

The present invention is further described in the detailed description which follows, in reference to the noted drawing by way of non-limiting examples of preferred embodiments of the present invention, and wherein:

The FIGURE illustrates a section of a dryer in a fibrous web production machine in which the fibrous web and a support belt are guided around a deflection roll by an external suction device.

DETAILED DESCRIPTION OF THE PREFERRED EMBODIMENTS

Figure 1:
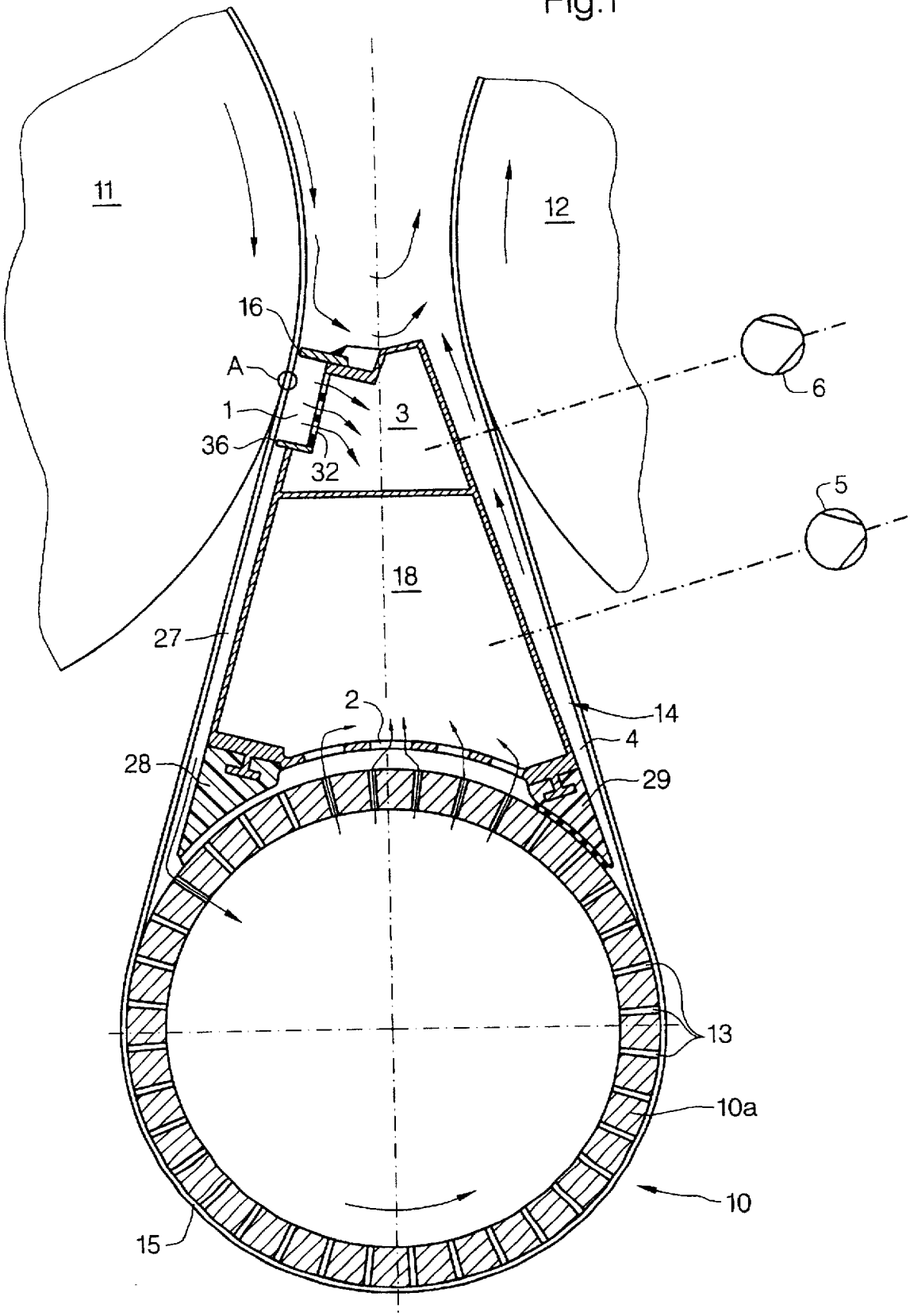

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawing making apparent to those skilled in the art how the several forms of the invention may be embodied in practice.

The FIGURE shows a cross section of a dryer device including two dryer cylinders 11 and 12, a deflection roll 10, and an external suction box 14 in accordance with the invention. A sheet of fibrous material (not shown) may rest directly upon drying cylinder 11. A support belt 15 may be located such that the sheet of fibrous material may be pressed between an outer surface of drying cylinder 11 and support belt 15. The sheet of fibrous material and support belt 15 may run or be guided around deflection roller 10 and then guided to a next downstream device, e.g., dryer cylinder 12. External suction box 14 may be located within a substantially triangular shaped region formed between dryer cylinders 11 and 12 and deflection roll 10.

Inside external suction box 14, two aspiration conduits 3 and 18 may be provided. Outside external suction box 14, sealing rails 28 and 29 may be provided to seal a portion of external suction box 14 that adjacently faces deflection roll 10. Seals 28 and 29 may enable aspiration conduit 18 to be sealed with respect a roll jacket 10*a* of deflection roll 10. A region 27, formed between external suction box 14 and support belt 15, may be aspirated by the vacuum created in aspiration conduit 18. Depending upon the proximity of sealing rail 29 to support belt 15, a region 4, formed between external suction box 14 and support belt 15, may also be aspirated, to a greater or lesser degree than region 27, by the vacuum created in aspiration conduit 18.

Deflection roll 10 may be, e.g., a perforated or porous roll. Thus, aspirated air may flow into aspiration conduit 18 and to an external vacuum source 5 through bores or perforations 13 formed within roll jacket 10*a* and through suction openings 2 formed in the external suction box 14.

A pick-up zone 1 may be formed adjacent to aspiration conduit 3. A sealing deflection rail 16 may be coupled to external suction box 14 and positioned adjacent dryer cylinder 11 at a location at which the fibrous sheet is in contact with both dryer cylinder 11 and support belt 15. By positioning sealing deflection rail 16 in this location, washboarding or rippling of support belt 15, generally caused by residual stress, cannot develop. Further, a substantially straight sealing line may be provided that extends along an entire width of the support belt and the fibrous sheet. Sealing deflection rail 16 may also be utilized to deflect air currents entrained by the movement of support belt 15 and the rotation of dryer cylinder 11. As shown by the arrows in the FIGURE, air currents entrained or carried by the moving support belt as it is guided around dryer cylinder 11 may be first deflected by sealing deflection rail 16 and then carried away by the air currents by support belt 15 as it is guided around dryer cylinder 12. Sealing rail 36 may be coupled to external suction box 14 and positioned adjacent to the support belt 15 and the fibrous sheet at a location after the support belt 15 and the fibrous sheet have been separated from dryer cylinder 11. Because of this positioning of sealing rail 36, the present invention ensures that, in an aspiration through aspiration conduit 3 and an external vacuum source 6, a rear ventilation may be made possible between the outer surface of the drying cylinder 11 and the sheet of fibrous material. As shown in the FIGURE, point A may represent the lift-off position, i.e., the location at which the fibrous web separates from dryer cylinder 11.

Thus, in accordance with the present invention, the external suction box may include a pick-up zone that may include sealing deflection rail 16, sealing rail 36 and suction openings 32. The pick-up zone may be coupled to aspiration conduit 3 located in, e.g., an upper portion of external suction box 14.

Further, in accordance with the present invention, aspiration conduit 3 may be subdivided into predefined a strip of adjacent aspiration zones arranged across the entire width of the fibrous sheet and support belt 15. Further, each aspiration zone may be coupled to a separate and discrete external vacuum source so that suction pressure across the width of the fibrous sheet may be varied in a predetermined manner. The present invention may also include combining similar zones (e.g. edge zones) to a single connection for an external vacuum source. The benefits of this arrangement include that within pick-up zone 1 at the edges of the fibrous sheet more intense suction should be provided than is generally required in the remaining interior region and that, when threading a sheet of fibrous material through the drying part, aspiration by individual aspiration zones is particularly important in at least the edge region of the fibrous sheet.

It is noted that the foregoing examples have been provided merely for the purpose of explanation and are in no way to be construed as limiting of the present invention.

While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A device for drying a sheet of fibrous material, the sheet guided, with a porous support belt, through a dryer section, including at least a first and second at least partially heatable dryer cylinder and at least one deflection roll having one of a perforated and porous roll jacket, the porous support belt guides the fibrous sheet from the first dryer cylinder to the deflection roll and from the deflection roll to the second dryer cylinder, the device comprising:

an external suction box coupled to a plurality of external vacuum sources, the external suction box comprising at least a first and second opening associated with respective at least first and second aspiration conduits;

the first opening positioned adjacent a circumferential portion the deflection roll and comprising a first and second seal rails extending along opposite sides of the first opening and adjacent the deflection roll;

the second opening positioned adjacent a portion of the porous belt that includes a lift-off point where the fibrous sheet separates from the first dryer cylinder;

the second opening comprising at least two sealing rails extending perpendicular to a direction of travel of the fibrous sheet and disposed on opposite sides of the lift-off point;

one of the at least two sealing rails comprising a deflection sealing rail that deflects air currents entrained by the porous support belt;

the plurality of external vacuum sources comprising a first external vacuum source coupled with an internal portion of the deflection roll and a second external vacuum source coupled with the lift-off point.

2. The device according to claim 1, the second aspiration conduit including a plurality of separate vacuum sources.

3. The device according to claim 1, further comprising a device that regulates an air flow of the second aspiration conduit.

4. The device according to claim 1, the second aspiration conduit comprising a plurality of adjacent chambers linearly arranged parallel to the at least two sealing rails, each chamber having a suction zone with varying suction.

5. The device according to claim 1, the second aspiration conduit comprising a separate suction zone located adjacent an edge of the fibrous sheet for threading the fibrous sheet.

6. An external suction box for use in a dryer in a fibrous sheet production machine, the dryer comprising a porous support belt guiding the fibrous sheet, at least a partially heatable first and second dryer cylinder, and at least one deflection roll having a perforated roll jacket, the porous support belt guiding the fibrous sheet around at least a portion of the first dryer cylinder, around a portion of the deflection roll, and around a portion of the second dryer cylinder, said external suction box comprising:

a first and second aspirating conduit, said first aspirating conduit connectable to a first external vacuum source and said second apirating conduit connectable to a second external vacuum source; and a separating wall that separates a vacuum pressure within said first aspirating conduit and a vacuum pressure with said second aspirating conduit.

7. The external suction box according to claim 6, further comprising:

a first opening and a first and second sealing rail, said first and second sealing rail located substantially parallel to each other and extending along an entire length of said external suction box and positioned on opposite sides of said first opening, said first opening being positionable adjacent to the deflection roll; and a second opening and a third and fourth sealing rail, said third and fourth sealing rail located substantially parallel to each other and extending along an entire length of said external suction box and positioned on opposite sides of said second opening, said second opening being positionable adjacent to a lift-off point at which the fibrous sheet separates from the first dryer cylinder.

8. The external suction box according to claim 7, in combination with the dryer of the production machine, said combination comprising:

a first external vacuum source coupled to said first aspirating conduit and a second external vacuum source coupled to said second aspirating conduit;

said first and second sealing rails abuttingly positioned against the deflection roll, said first external vacuum source communicating with an interior portion of the deflection roll; and said third and fourth sealing rails positioned adjacent a pick-up zone, said pick-up zone comprising said lift-off point, and said second external vacuum source facilitating in separating the fibrous sheet from the first dryer cylinder.

9. The external suction box in combination with the dryer according to claim 8, said third sealing rail located upstream said fourth sealing rail with respect to a direction of fibrous sheet travel;

said third sealing rail further deflecting air currents entrained by movment of the porous support belt.

10. The external suction box in combination with the dryer according to claim 8, said first aspiration conduit aspirating a region located between the porous support belt and an exterior of said external suction box.

11. The external suction box in combination with the dryer according to claim 10, said region located between the porous support belt and said exterior of said external suction box comprising at least one of between the first dryer cylinder and the deflection roll and between the deflection roll and the second dryer cylinder.

12. The external suction box in combination with the dryer according to claim 8, said first external vacuum source and said second external vacuum souce exerting different vacuum pressures.

13. The external suction box in combination with the dryer according to claim 8, said second aspirating conduit comprising a plurality of chambers, each said chamber adjacently arranged along the entire length of the external suction box.

14. The external suction box in combination with the dryer according to claim 13, each said chamber coupled to a separate vacuum source to vary the vacuum pressure along the length of the external suction box.

15. The external suction box in combination with the dryer according to claim 14, vacuum pressure sources is associated with chambers located adjacent an edge of the fibrous sheet exerting a higher pressure than vacuum pressure sources associated with chambers located adjacent internal portions of the fibrous sheet.

16. The external suction box in combination with the dryer according to claim 8, said first and second rails located substantially close to a run-on point and lift-off point of the deflection roll, said external suction box coupled to substantially an entire circumference of the deflection roll not abutting the porous support belt.

17. The external suction box according to claim 6, said first aspiration conduit comprising a plurality of chambers.

18. The external suction box according to claim 17, said plurality of chamber located adjacent one another and extending along an entire length of said external suction box.

19. The external suction box according to claim 6, further comprising a housing positionable between the porous support belt and the deflection roll; and said housing comprising a first and second opening, said first opening coupled to said first aspirating conduit and second opening coupled to said second aspirating conduit.

20. The external suction box according to claim 19, said housing being substantially triangular in shape.

* * * * *